United States Patent [19]

Endo et al.

[11] Patent Number: 4,756,478

[45] Date of Patent: Jul. 12, 1988

[54] VIBRATING ELEMENT FOR USE ON AN ULTRASONIC INJECTION NOZZLE

[75] Inventors: Masami Endo, Kawasaki; Kakuro Kokubo, Atsugi; Hideo Hirabayashi, Yachiyo; Yoshinobu Nakamura, Urawa; Daijiro Hosogai, Kawajima, all of Japan

[73] Assignee: Toa Nenryo Kogyo Kabushiki Kaisha, Tokyo, Japan

[21] Appl. No.: 807,134

[22] Filed: Dec. 6, 1985

[30] Foreign Application Priority Data

Dec. 11, 1984 [JP] Japan ..... 59-260064

[51] Int. Cl.[4] ..... B05B 1/08

[52] U.S. Cl. ..... 239/102.2; 239/498; 239/500

[58] Field of Search ..... 239/102, 498, 500, 501, 239/102.2

[56] References Cited

U.S. PATENT DOCUMENTS 1,659,538 2/1928 Angrove ..... 239/500
3,110,444 11/1963 Eakins ..... 239/500

FOREIGN PATENT DOCUMENTS 159189 10/1985 European Pat. Off. ..... 239/102
786492 9/1935 France ..... 239/498

*Primary Examiner*—Andres Kasnikow
*Assistant Examiner*—Michael J. Forman
*Attorney, Agent, or Firm*—Seidel, Gonda, Goldhammer & Abbott

[57] ABSTRACT

The present invention is directed to the combination of a vibrating element and an ultrasonic nozzle having an ultrasonic vibrator. The combination includes a body having a liquid supply passage therethrough and a chamber having a first and second end. The liquid supply passage is in communication with the chamber via its first end. The second end of the chamber defines an opening. An inner peripheral wall forms a portion of the chamber intermediate the first and second end. A multistepped edged portion is formed on the inner peripheral wall and each step defines an edge which severs and atomizes the liquid which cascades thereover from the liquid passage.

4 Claims, 2 Drawing Sheets

VIBRATING ELEMENT FOR USE ON AN ULTRASONIC INJECTION NOZZLE

TECHNICAL FIELD

This invention relates generally to an ultrasonic injection nozzle, and particularly to a vibrating element for use with ultrasonic atomizing apparaus for atomizing liquid intermittently or continuously, such ultrasonic atomizing apparatus including (1) automobile fuel injection nozzles such as electronically controlled gasoline injection valves or electronically controlled diesel injection valves, (2) gas turbine fuel nozzles, (3) burners for use on industrial, commercial and domestic boilers, heating furnaces and stoves, (4) industrial liquid atomizers such as drying atomizers for drying liquid materials such as foods, medicines, agricultural chemicals, fertilizers and the like, spray heads for controlling temperature and humidity, atomizers for calcining powders (pelletizing ceramics), spray coaters and reaction promoting devices, and (5) liquid atomizers for uses other than industrial, such as spreaders for agricultural chemicals and antiseptic solution.

BACKGROUND ART

Pressure atomizing burners or liquid spray heads have been heretofore used to atomize or spray liquid in the various fields of art as mentioned above. The term "liquid" herein used is intended to mean not only liquid but also various liquid materials such as solution, suspension and the like. Injection nozzles used with such spray burners or liquid atomizers relied for atomizing the liquid on the shearing action between the liquid as discharged through the nozzles and the ambient air (atmospheric air). Thus, increased pressured under which liquid was supplied was required to achieve atomization of the liquid, resulting in requiring complicated and large-sized liquid supplying means such as pumps and piping.

Furthermore, regulation of the flow rate of injection was effected either by varying the pressure under which to deliver supply liquid or by varying the area of the nozzle discharge opening. However, the former method provided poor atomization at a low flow rate (low pressure), as a remedy for which air or stream was additionally used on medium or large-sized boilers to aid in atomization of liquid, requiring more and more complicated and enlarged apparatus. On the other hand, the latter method required an extremely intricate construction of nozzle which was troublesome to control and maintain.

In order to overcome the drawbacks to such conventional injection nozzles, attempts have been made to impart ultrasonic waves to liquid material as it is injected out through the jet of the injection nozzle under pressure.

However, the conventional ultrasonic liquid injecting nozzle had so small capacity for spraying that it was unsuitable for use as such injection nozzle as described above which required a large amount of atomized liquid.

As a result of extensive researches and experiments conducted on the ultrasonic liquid atomizing mechanism and the configuration of the ultrasonic vibrating element in an attempt to accomplish atomization of a large amount of liquid, the present inventors have discovered that a large quantity of liquid may be atomized by providing an ultrasonic vibrating element formed at its end with an edged portion along which liquid may be delivered in a film form, and have proposed an ultrasonic injection method and injection nozzle based on said concept as disclosed in Japanese Patent Application No. 59-77572.

The present invention relates to improvements on the ultrasonic injection nozzle of the type according to the invention of the aforesaid earlier patent application, and particularly to improvements on the vibrating element for use with such ultrasonic injection nozzle.

SUMMARY OF THE INVENTION

It is an object of this invention to provide a vibrating element for use with an ultrasonic injection nozzle which is capable of delivering liquid intermittently or continuously.

It is another object of the invention to provide a vibrating element for an ultrasonic injection nozzle which is capable of delivering and atomizing or spraying a large quantity of liquid.

It is still another object of the injection to provide a vibrating element for an ultrasonic injection nozzle which is of simple construction and which facilitates delivery of liquid and provides for reducing the size, weight and initial cost of the associated liquid supplying facility, as compared to the prior art spray nozzle and ultrasonic injection nozzle.

It is another object of the invention to provide a vibrating element for an ultrasonic injection nozzle which is capable of accomplishing consistent atomization in that there is no change in the conditions of atomization (flow rate and particle size) depending upon the properties, particularly the viscosity of the supply liquid.

It is yet another object of the invention to provide a vibrating element for an ultrasonic injection nozzle which provides for stable and substantially consistent atomization even at a flow rate, and hence permits a very high turndown ratio.

The aforesaid objects may be accomplished by the vibrating element for an ultrasonic injection nozzle according to the present invention.

Briefly, this invention consists in a vibrating element for use on an ultrasonic injection nozzle, said element being formed around its inner periphery with a multi-stepped edged portion having one or more steps each defining an edge, said edged portion being supplied with liquid through liquid supply passage means extending through the interior of said element.

Specific embodiments of the present invention will now be described by way of example and not by way of limitation with reference to the accompanying drawings.

DESCRIPTION OF THE EMBODIMENTS

Figure 1:
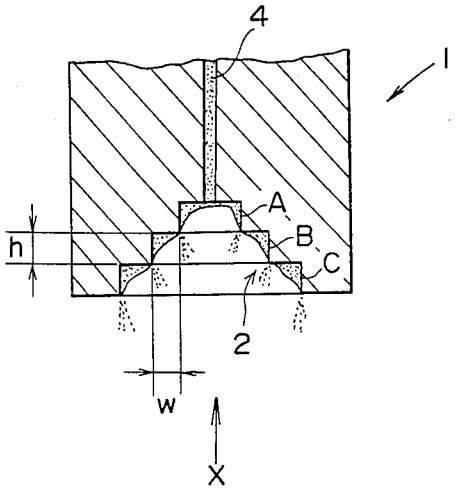
FIG. 1 is a fractionary cross-sectional view of one embodiment of the vibrating element for an ultrasonic injection nozzle according to this invention.

Referring to the accompanying drawings and first to FIG. 1, one embodiment of the vibrating element for use with an ultrasonic injection nozzle according to the present invention is illustrated.

According to this invention, the vibrating element 1 is formed in its forward end with an annular edged portion 2 including one or more concentric steps, three steps (A), (B), and (C) in the illustrated embodiment. Each step defines an edge, the edges of said steps having progressively increasing diameter. The shape of the edged portion 2 as viewed in the direction indicated by the arrow (X) is not limited to a circle but may be triangular, square or any other polygonal shape.

The geometry such as the width (w) and height (h) of each step of the edged portion is such that the edge of the step may act to render the liquid flow filmy and to dam the liquid flow.

The edged portion 2 of the vibrating element according to this invention is supplied with liquid through a liquid supply passage 4 extending through the interior of the vibrating element. Such direct delivery of liquid from the interior of the vibrating element into the edged portion 2 facilitates supplying liquid and provides for reducing the size, weight and initial cost of the associated liquid supplying facility, as compared to the conventional injection nozzle and ultrasonic spray nozzle.

With the construction as described above, as liquid, which is fuel in the illustrated embodiment, is fed to the edged portion 2, the stream of fuel is severed and atomized at each edge due to the vertical vibrations imparted to the vibrating element. More specifically, fuel is first partially atomized at the edge (A) of the first step, and the excess portion of the fuel which has not been handled at the first step (A) is fed further through the second step (B) and the third step (C) to be handled thereby. It is to be understood that at a higher flow rate of fuel a larger effective area is required for atomization, requiring a greater number of stepped edges. At a lower flow rate, however, a smaller number of steps are required before the atomization of fuel is completed. With the vibrating element 1 according to the present invention, the number of steps required will vary with changes in the flow rate so as to insure generally uniform conditions such as the thickness of liquid film at the location of each step where the atomization takes place, resulting in uniform particle size of the droplets being atomized. The vibrating element of this invention provides a full range of flow rates usually required for atomization, so that atomization of various types of liquid material may be accomplished, whether it may be on an intermittent basis or on a continuous basis.

Figure 2:
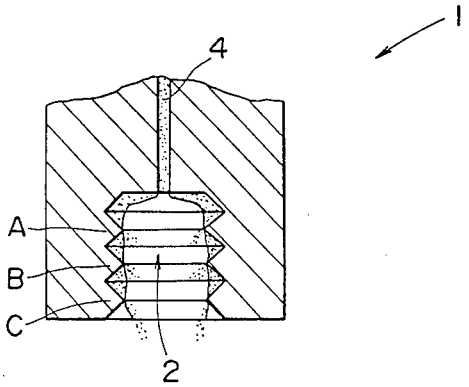
FIG. 2 is a fractionary cross-sectional view of another embodiment of the vibrating element for an ultrasonic injection nozzle according to this invention.

FIG. 2 illustrates an alternate form of the vibrating element according to this invention in which the edged portion 2 comprises annular protrusions (A), (B) and (C) having the same angular shape in cross section and the same diameter.

An ultrasonic injection nozzle 10 in which the vibrating element 1 constructed according to this invention is incorporated will be described with reference to FIG. 3. While the present invention is suitably applicable to injection or spray nozzles for various uses as indicated hereinbefore, it will be described with reference to a fuel injection nozzle for a gas turbine.

Figure 3:
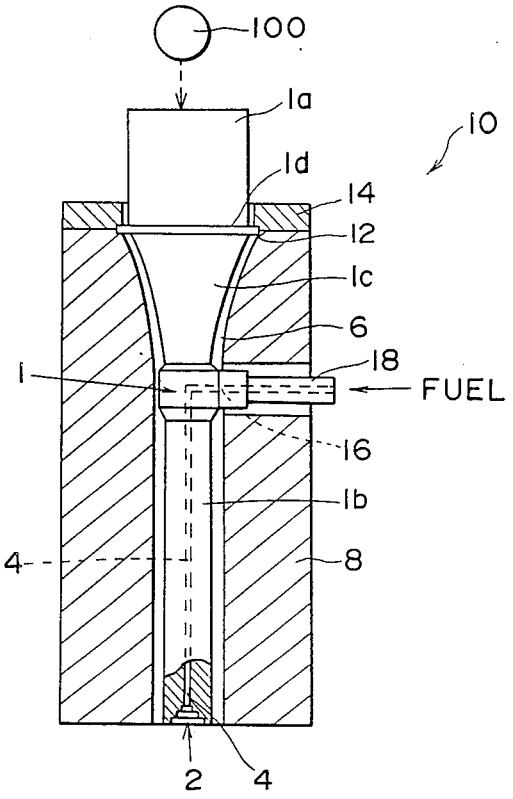
FIG. 3 is a cross-sectional view of one embodiment of an ultrasonic injection nozzle incorporating a vibrating element according to this invention.

Referring to FIG. 3, an injection nozzle which is a fuel nozzle 10 for a gas turbine in the illustrated embodiment includes a generally cylindrical elongated valve housing 8 having a central bore 6 extending through the center thereof. A vibrating element 1 according to this invention is disposed extending through the central bore 6 of the valve housing 8. The vibrating element 1 includes an upper body portion 1*a*, an elongated cylindrical vibrator shank 1*b* having a diameter smaller than that of the body portion 1*a*, and a transition portion 1*c* connecting the body portion 1*a* and the shank 1*b*. The body portion 1a has an enlarged diameter flange 1*d* which is attached to the valve housing 8 by a shoulder 12 formed in the upper end of the valve housing and an annular vibration retainer 14 fastened to the upper end face of the valve housing by bolts (not shown). The forward end of the vibrating element 1, that is, the forward end of the shank 1*b* is formed with an edged portion 2. The shank 1*b* has one or more supply passages 4 formed therethrough for feeding said edged portion 2. Communicating with the upper end of the supply passage 4 is a radial fuel inlet port 16 which is in turn connected with a fitting 18 for coupling with an external supply line (not shown) leading to a source of fuel (not shown). The flow and flow rate of fuel are controlled by a supply valve (not shown) disposed in the external supply line. Alternatively, although not shown here, a solenoid-operated needle valve of conventional construction may be disposed in the supply passage 4 to open and close the passage for controlling the flow of fuel to the edged portion 2.

With the construction described above, the vibrating element 1 is continuously vibrated by an ultrasonic generator 100 operatively connected to the body portion 1*a*. Liquid fuel is thus fed through the external line, the supply valve and the supply passage 4 to the edged portion 2 where the fuel is atomized and discharged out.

An example of various parameters and dimensions applicable to the ultrasonic injection nozzle according to this invention is as follows:

| | |
|---|---|
| Output of ultrasonic vibration generating means | 10 watts. |
| Amplitude of vibration of vibrating element | 30 um |
| Frequency of vibration | 38 KHz |
| Geometry of edged portion of vibrating element | |
| First step | 7 mm in diameter |
| Second step | 8 mm in diameter |
| Third step | 10 mm in diameter |
| Height (h) of each step | 1.5 mm |
| Fuel - type of oil | gas oil, kerosene, gasoline |
| Flow rate | 0–0.06 $cm^3$ per injection |
| Injection pressure | 1–70 $Kg/cm^2$ |
| Temperature | normal temperature |
| Material for vibrating element | Titanium (or iron). |

It is to be appreciated from the foregoing description that the vibrating element according to this invention is simple in construction as compared to the conventional spray nozzle and ultrasonic injection nozzle, facilitates delivery of fuel, and provides for reducing the size, weight and initial cost of the associated liquid supplying facility. In addition, the vibrating element of this invention makes it possible to provide an ultrasonic injection nozzle which is capable of accomplishing consistent atomization in that there is no change in the conditions of atomization (flow rate and particle size) depending upon the properties, particularly the viscosity of the supply liquid. Furthermore, the present vibrating element provides for stable and substantially consistent atomization even at a low flow rate, and hence permits a very high turndown ratio.

What is claimed is:

1. The vibrating element in combination with an ultrasonic nozzle typically having an ultrasonic vibrating means comprises:

a body having a liquid supply passage means therethrough and a chamber having a first and second end;

said liquid supply means being in communication with said chamber via said first end, said liquid supply passage means adapted for passing liquid into said chamber;

said second end defining an opening;

an inner peripheral wall forming a portion of said chamber intermediate said first and second end;

a multi-stepped edge portion being formed on said inner peripheral wall, each step of said multi-stepped edge portion defining an edge, each said edge being adapted to sever and atomize said liquid;

whereby liquid supplied via said passage means cascades over said edges and is atomized from said edges when said body is driven by the ultrasonic vibrating means.

2. A vibrating element according to claim 1 wherein said edges of said steps have progressively increasing diameters from said first end and to said second end.

3. A vibrating element according to claim 1 wherein the edges of said steps have the same diameter.

4. A vibrating element according to claim 1 wherein said multi-stepped edged portion has at least two steps.

* * * * *